US009989885B2

(12) United States Patent
Saito et al.

(10) Patent No.: US 9,989,885 B2
(45) Date of Patent: Jun. 5, 2018

(54) IMAGE FORMING APPARATUS AND LUBRICANT DISCHARGE CONTROL METHOD

(71) Applicant: Konica Minolta, Inc., Chiyoda-ku, Tokyo (JP)

(72) Inventors: Kazuhiro Saito, Hino (JP); Tomohiro Kawasaki, Sagamihara (JP); Hiroyuki Saito, Tokyo (JP); Kei Yuasa, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 15/450,406

(22) Filed: Mar. 6, 2017

(65) Prior Publication Data

US 2017/0261882 A1 Sep. 14, 2017

(30) Foreign Application Priority Data

Mar. 10, 2016 (JP) ..... 2016-046989

(51) Int. Cl.
*G03G 15/08* (2006.01)
*G03G 21/00* (2006.01)

(52) U.S. Cl.
CPC ..... *G03G 15/0848* (2013.01); *G03G 15/0844* (2013.01); *G03G 15/0896* (2013.01); *G03G 21/00* (2013.01)

(58) Field of Classification Search
CPC ..... G03G 15/065; G03G 15/0896; G03G 15/0844; G03G 15/0848; G03G 21/00; G03G 2221/0036
USPC ..... 399/127, 257, 346
See application file for complete search history.

(56) References Cited

U.S. PATENT DOCUMENTS

2006/0285897 A1* 12/2006 Sugiura ..... G03G 21/00 399/346
2011/0268466 A1* 11/2011 Kimura ..... G03G 15/757 399/71
2013/0071163 A1* 3/2013 Watanabe ..... G03G 15/0189 399/346
2015/0030364 A1* 1/2015 Ito ..... G03G 21/0094 399/346
2016/0282771 A1* 9/2016 Sato ..... G03G 15/1665
2017/0038720 A1* 2/2017 Hirai ..... G03G 15/5058
(Continued)

FOREIGN PATENT DOCUMENTS

JP 11015330 A * 1/1999
JP 2009008716 A * 1/2009
(Continued)

*Primary Examiner* — Robert Beatty
(74) *Attorney, Agent, or Firm* — Buchanan Ingersoll & Rooney PC

(57) ABSTRACT

An image forming apparatus includes: an image carrier; a developing unit which supplies a toner contained in a developer to the image carrier; a lubricant supply unit which supplies a lubricant to the image carrier; a lubricant amount detection unit which detects an amount of the lubricant which is supplied to the image carrier from the lubricant supply unit and is thereafter incorporated into the developing unit from the image carrier; and a control unit which controls the developing unit to discharge the lubricant from the developing unit according to the amount of the lubricant detected by the lubricant amount detection unit.

20 Claims, 7 Drawing Sheets

(56) References Cited

U.S. PATENT DOCUMENTS

2017/0045857 A1* 2/2017 Hirai ..... G03G 21/0094
2017/0123358 A1* 5/2017 Sato ..... G03G 15/50

FOREIGN PATENT DOCUMENTS

JP 2010-230931 A 10/2010
JP 2013101273 A * 5/2013

* cited by examiner

IMAGE FORMING APPARATUS AND LUBRICANT DISCHARGE CONTROL METHOD

The entire disclosure of Japanese Patent Application No. 2016-046989 filed on Mar. 10, 2016 including description, claims, drawings, and abstract are incorporated herein by reference in its entirety.

BACKGROUND OF THE INVENTION

Field of the Invention

The present invention relates to an image forming apparatus and a lubricant discharge control method.

Description of the Related Art

In general, an image forming apparatus (a printer, copying machine, or fax machine) which uses an electrophotographic process technology forms an electrostatic latent image by irradiating (exposing) a charged photosensitive drum (image carrier) with laser light based on image data. In addition, the electrostatic latent image is visualized by supplying toner to the photosensitive drum, on which the electrostatic latent image is formed, from a developing device such that a toner image is formed. Moreover, the toner image is directly or indirectly transferred onto a sheet and is thereafter heated and pressed by a fixing nip so as to be fixed, thereby forming the toner image on the sheet.

However, with the demand of image forming apparatuses in recent years for higher resolution, as toner used for image formation, toner having a small diameter and a spherical shape is employed. In a case where the toner having a small diameter and a spherical shape is used, transfer residual toner is likely to slip between a cleaning blade, which scrapes off the transfer residual toner adhered onto the photosensitive drum, and the photosensitive drum.

The reason for this is that, in a case of toner having a small diameter, the force of adhesion between the toner and the photosensitive drum is strengthened by van der Waals forces and thus the toner easily enters a contact portion between the photosensitive drum and the cleaning blade. In addition, in a case of toner having a spherical shape, the toner is likely to slip between the photosensitive drum and the cleaning blade and easily enters the contact portion between the photosensitive drum and the cleaning blade.

In order to solve the problem with the toner on the photosensitive drum slipping through the cleaning blade, for example, JP 2010-230931 A discloses a technique for reducing the coefficient of friction on a photosensitive drum by supplying a lubricant onto the photosensitive drum. In this technique, by supplying the lubricant to the photosensitive drum, the force of adhesion of the toner to the photosensitive drum and the frictional force thereof decrease, and toner can be sufficiently removed by a cleaning blade. In addition, as the toner is easily removed from the photosensitive drum, the force of the cleaning blade contacting the photosensitive drum can be reduced, and an increase in the service life of the cleaning blade and the photosensitive drum can be achieved. Furthermore, due to a reduction in the coefficient of friction of the photosensitive drum, the efficiency in transferring a toner image is improved, and filming caused by foreign matter adhered onto the photosensitive drum and the like can be prevented.

However, when the lubricant supplied onto the photosensitive drum passes through a developing roller part of a developing device, there may be cases where the lubricant is scraped off by a magnetic brush constituted by a carrier and the toner formed on the developing roller and is incorporated into the developing device. When the lubricant is incorporated into the developing device, the lubricant adheres to the toner and thus impedes triboelectric charging between the toner and the carrier. Accordingly, a state in which toner with a reduced charge amount is present in the developing device or a state in which toners which are positively charged and negatively charged coexist with each other is caused. Therefore, there is a problem that image defects caused by fogging, toner scattering, and the like are likely to be generated. Even if the amount of the lubricant supplied to the photosensitive drum is reduced, the lubricant incorporated into the developing device during image formation is accumulated, and it is difficult to solve the problems of fogging and toner scattering through durability.

SUMMARY OF THE INVENTION

An object of the present invention is to provide an image forming apparatus and a lubricant discharge control method capable of suppressing the generation of image defects caused by a lubricant incorporated into a developing unit.

To achieve the abovementioned object, according to an aspect, an image forming apparatus reflecting one aspect of the present invention comprises:

an image carrier;

a developing unit which supplies a toner contained in a developer to the image carrier;

a lubricant supply unit which supplies a lubricant to the image carrier;

a lubricant amount detection unit which detects an amount of the lubricant which is supplied to the image carrier from the lubricant supply unit and is thereafter incorporated into the developing unit from the image carrier; and a control unit which controls the developing unit to discharge the lubricant from the developing unit according to the amount of the lubricant detected by the lubricant amount detection unit.

To achieve the abovementioned object, according to an aspect, there is provided a lubricant discharge control method of an image forming apparatus including an image carrier, a developing unit which supplies toner contained in a developer to the image carrier, and a lubricant supply unit which supplies a lubricant to the image carrier, and the method reflecting one aspect of the present invention comprises:

acquiring an amount of the lubricant which is supplied to the image carrier from the lubricant supply unit and is thereafter incorporated into the developing unit from the image carrier; and controlling the developing unit to discharge the lubricant from the developing unit according to the acquired amount of the lubricant.

To achieve the abovementioned object, according to an aspect, an image forming apparatus reflecting one aspect of the present invention comprises:

an image carrier;

a developing unit which supplies a toner contained in a developer to the image carrier;

a lubricant supply unit which supplies a lubricant to the image carrier;

a lubricant amount detection unit which detects an amount of the lubricant which is supplied to the image carrier from the lubricant supply unit and is thereafter incorporated into the developing unit from the image carrier; and a control unit which controls the developing unit to discharge the lubricant from the developing unit according to the amount of the lubricant detected by the lubricant amount detection unit, wherein the control unit controls the developing unit to increase a discharge amount of the lubricant in the developing unit as the amount of the lubricant in the developing unit increases.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
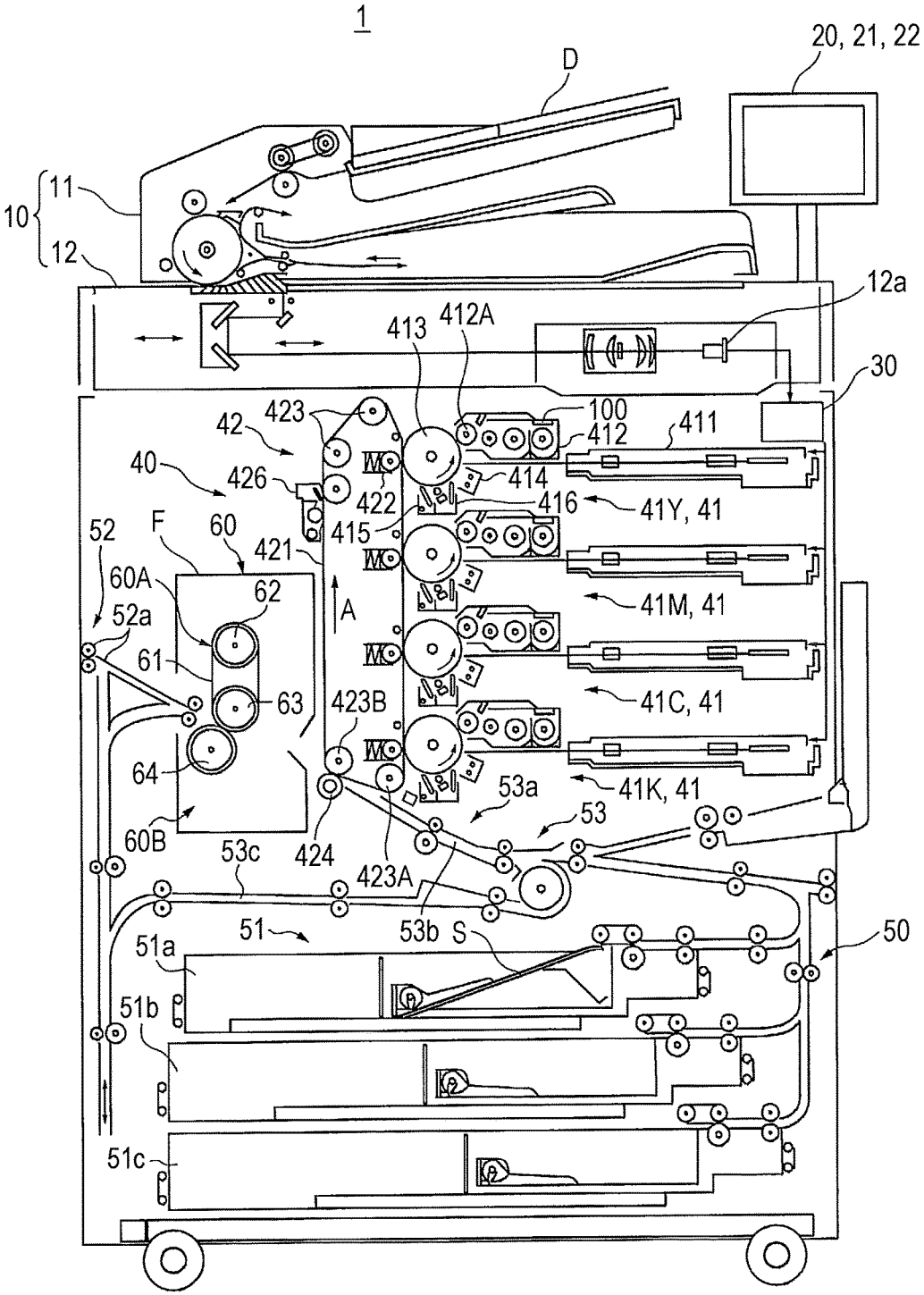
FIG. 1 is a view schematically illustrating the overall configuration of an image forming apparatus according to an embodiment.
Figure 2:
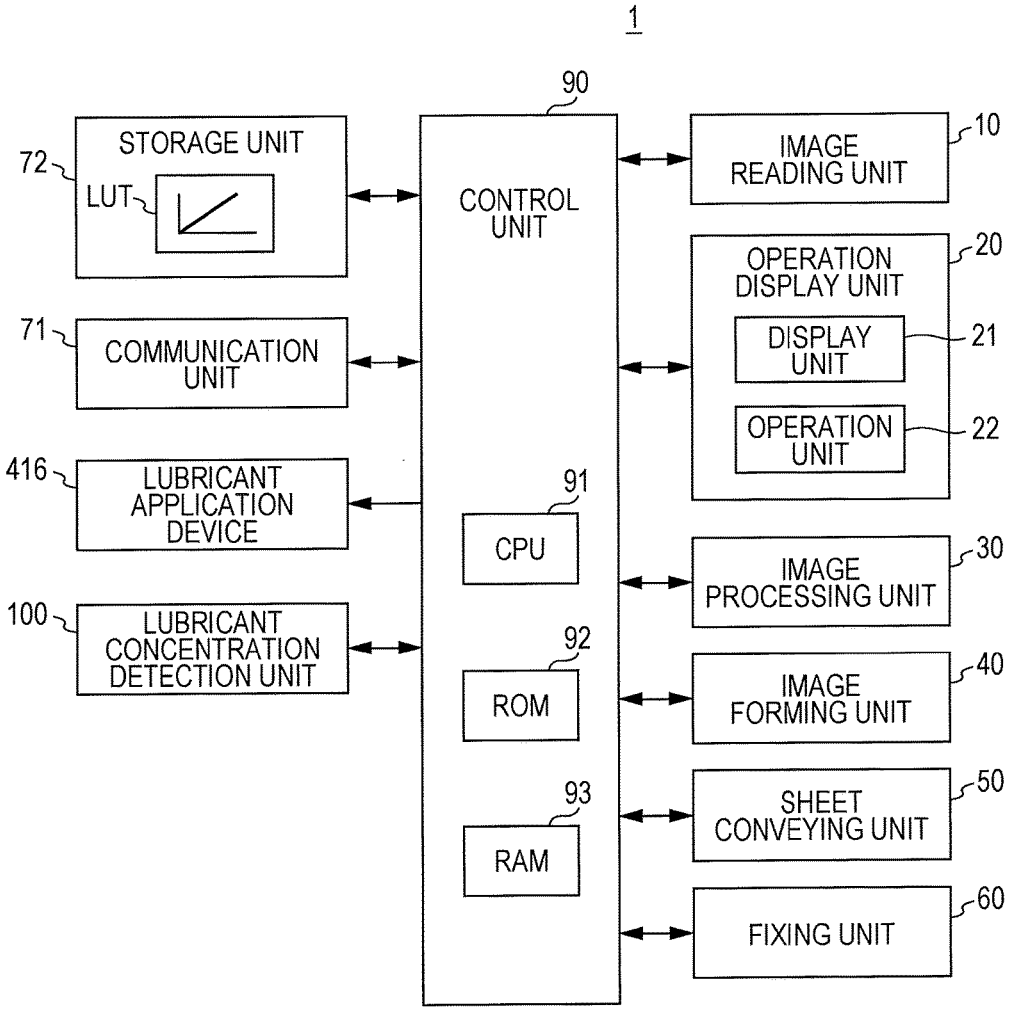
FIG. 2 is a view illustrating main units of a control system of the image forming apparatus according to the embodiment.

Hereinafter, an embodiment of the present invention will be described in detail with reference to the drawings. However, the scope of the invention is not limited to the illustrated examples. FIG. 1 is a view schematically illustrating the overall configuration of an image forming apparatus 1 according to the embodiment. FIG. 2 is a view illustrating main units of a control system of the image forming apparatus 1 according to the embodiment.

The image forming apparatus 1 illustrated in FIGS. 1 and 2 is an intermediate transfer type color image forming apparatus which uses an electrophotographic process technology. That is, the image forming apparatus 1 primarily transfers toner images of colors of Y (yellow), M (magenta), C (cyan), and K (black) formed on photosensitive drums 413 on an intermediate transfer belt 421, superimposes the toner images of the four colors on the intermediate transfer belt 421, and thereafter secondarily transfers the toner images on a sheet S, thereby forming an image.

In addition, the image forming apparatus 1 employs a tandem type in which the photosensitive drums 413 corresponding to the four YMCK colors are arranged in series in the running direction of the intermediate transfer belt 421 and the toner images of the respective colors are sequentially transferred to the intermediate transfer belt 421 in a single procedure.

The image forming apparatus 1 includes an image reading unit 10, an operation display unit 20, an image processing unit 30, an image forming unit 40, a sheet conveying unit 50, a fixing unit 60, and a control unit 90.

The control unit 90 includes a central processing unit (CPU) 91, a read-only memory (ROM) 92, a random-access memory (RAM) 93, and the like. The CPU 91 reads a program corresponding to the processing content from the ROM 92, develops the program in the RAM 93, and centrally controls the operation of each block of the image forming apparatus 1 in cooperation with the developed program. At this time, various types of data stored in a storage unit 72 are referred to. The storage unit 72 is formed as, for example, a non-volatile semiconductor memory (so-called flash memory) or a hard disk drive.

The control unit 90 transmits and receives various types of data to and from an external device (for example, a personal computer) connected to a communication network such as a local area network (LAN) or wide area network (WAN) via a communication unit 71. The control unit 90 receives, for example, image data (input image data) transmitted from the external device, and causes an image to be formed on the sheet S based on the image data. The communication unit 71 is formed as a communication control card such as a LAN card.

The image reading unit 10 includes an automatic document feeder 11 called an ADF, a document image scanner 12 (scanner), and the like.

The automatic document feeder 11 conveys a document D placed on a document tray by a conveying mechanism and sends the document D to the document image scanner 12. Images (including both sides) of a large number of documents D placed on the document tray can be continuously read by the automatic document feeder 11 at one stroke.

The document image scanner 12 optically scans a document conveyed onto a contact glass from the automatic document feeder 11 or a document placed on the contact glass and to image light reflected from the document on a light-receiving surface of a charge coupled device (CCD) sensor 12*a*, thereby reading the document image. The image reading unit 10 generates input image data based on the reading result by the document image scanner 12. The input image data is subjected to predetermined image processing in the image processing unit 30.

The operation display unit 20 is formed as, for example, a liquid crystal display (LCD) with a touch panel, and functions as a display unit 21 and an operation unit 22. The display unit 21 displays various operation screens, the state of an image, the operation state of each function, and the like according to a display control signal input from the control unit 90. The operation unit 22 includes various operation keys such as a numeric keypad and a start key, receives various input operations by a user, and outputs an operation signal to the control unit 90.

The image processing unit 30 includes a circuit or the like for performing digital image processing corresponding to initial settings or user settings, on the input image data. For example, under the control of the control unit 90, the image processing unit 30 performs tone correction based on tone correction data (tone correction table). In addition to the tone correction, the image processing unit 30 performs various correction processes such as color correction and shading correction, a compression process, and the like on the input image data. The image forming unit 40 is controlled based on the image data subjected to these processes.

The image forming unit 40 includes image forming units 41Y, 41M, 41C, and 41K for forming images of color toners of the Y component, the M component, the C component, and the K component based on the input image data, an intermediate transfer unit 42, and the like.

The image forming units 41Y, 41M, 41C, and 41K for the Y component, the M component, the C component, and the K component have the same configuration. For convenience of illustration and description, like elements which are common to each other are denoted by like reference numerals, and in a case of separation therebetween, Y, M, C, or K is added to the reference numerals. In FIG. 1, only the constituent elements of the image forming unit 41Y for the Y component are denoted by reference numerals, and the reference numerals of the constituent elements of the other image forming units 41M, 41C, 41K are omitted.

The image forming unit 41 includes an exposing device 411, a developing device 412, the photosensitive drum 413, a charging device 414, a drum cleaning device 415, a lubricant application device 416, and the like. The photosensitive drum 413 corresponds to an "image carrier" of the present invention. The developing device 412 corresponds to a "developing unit" of the present invention. The lubricant application device 416 corresponds to a "lubricant supply unit" of the present invention.

The photosensitive drum 413 is a negative charge type organic photo-conductor (OPC) in which an under coat layer (UCL), a charge generation layer (CGL), and a charge transport layer (CTL) are sequentially laminated on the circumferential surface of a conductive cylindrical body made of aluminum (aluminum raw tube).

The charging device 414 uniformly negatively charges the surface of the photosensitive drum 413 having photoconductivity by generating a corona discharge.

The exposing device 411 is formed as, for example, a semiconductor laser, and irradiates the photosensitive drum 413 with laser light corresponding to an image of the corresponding color component. A positive charge is generated in the charge generation layer of the photosensitive drum 413 and is transported to the surface of the charge transport layer such that the surface charge (negative charge) of the photosensitive drum 413 is neutralized. An electrostatic latent image of the corresponding color component is formed on the surface of the photosensitive drum 413 due to a potential difference from the surroundings.

The developing device 412 is a two-component inversion type developing device and visualizes the electrostatic latent image by adhering toner of the corresponding color component to the surface of the photosensitive drum 413, thereby forming a toner image. A developing sleeve 412A of the developing device 412 carries a developer while rotating, and supplies the toner contained in the developer to the photosensitive drum 413. Specifically, a developing bias that is an AC bias is applied to the developing sleeve 412A from a developing bias application unit (not illustrated), and a potential difference is generated between the developing sleeve 412A and the surface of the photosensitive drum 413 such that a toner image is formed on the surface of the photosensitive drum 413.

Figure 3:
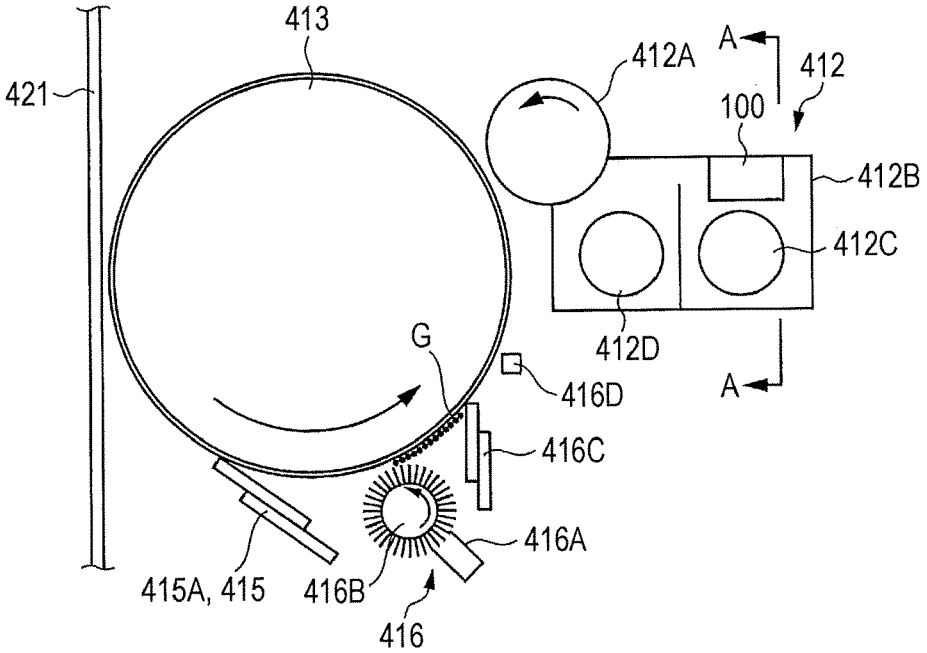
FIG. 3 is a view illustrating parts of a developing device and a photosensitive drum.

In addition, as illustrated in FIG. 3, a first agitating member 412C and a second agitating member 412D are provided in a developer housing 412B in which the developer is accommodated in the developing device 412, in order from the right in FIG. 3. The first agitating member 412C and the second agitating member 412D are configured to convey the developer in the axial direction thereof while rotating, and agitate the developer in the developer housing 412B. The developing device 412 in FIG. 3 is illustrated in a more simplified manner than the developing device 412 in FIG. 1.

In this embodiment, the amount of the developer accommodated in the developer housing 412B is set to 650 g, the amount of toner conveyed to the photosensitive drum 413 from the developing sleeve 412A is set to 250±100 g/m$^2$, the distance between the developing sleeve 412A and the photosensitive drum 413 is set to 0.25±0.04 mm.

A lubricant concentration detection unit 100 is provided in the developing device 412. The lubricant concentration detection unit 100 is disposed at the upper wall of the developer housing 412B above the first agitating member 412C, detects the concentration of the lubricant G adhered to the toner accommodated in the developing device 412, and outputs the detection result to the control unit 90. Details of the lubricant concentration detection unit 100 will be described later.

The drum cleaning device 415 has a drum cleaning blade 415A which is in sliding contact with the surface of the photosensitive drum 413, and the like, and removes transfer residual toner remaining on the surface of the photosensitive drum 413 after primary transfer.

The lubricant application device 416 has a solid lubricant 416A, a brush roller 416B, and a blade 416C.

The solid lubricant 416A is a lubricant made of a metal soap such as zinc stearate formed into a rectangular parallelepiped shape. The brush roller 416B is rotatably disposed between the solid lubricant 416A and the photosensitive drum 413 while being in contact therewith. The brush roller 416B scrapes off the lubricant G from the solid lubricant 416A while rotating, and holds the lubricant G, and supplies the lubricant G onto the photosensitive drum 413.

The blade 416C is a rubber-like leveling blade and is disposed on the downstream side of the solid lubricant 416A and the brush roller 416B, and is configured to press the lubricant G supplied onto the photosensitive drum 413 against the photosensitive drum 413. As the lubricant G is pressed against the blade 416C, the lubricant G is applied onto the photosensitive drum 413.

A lubricant supply amount detection unit 416D is provided at an appropriate position facing the surface of the photosensitive drum 413. For example, the lubricant supply amount detection unit 416D detects the application amount of the lubricant G based on the amount of light reflected on the surface of the photosensitive drum 413, and the like, and outputs the detection result to the control unit 90. The control unit 90 controls the lubricant application device 416 so that the application amount of the lubricant G on the photosensitive drum 413 becomes a constant amount, based on the detection result detected by the lubricant supply amount detection unit 416D.

As illustrated in FIG. 1, the intermediate transfer unit 42 includes the intermediate transfer belt 421, a primary transfer roller 422, a plurality of support rollers 423, a belt cleaning device 426, and the like.

The intermediate transfer belt 421 is formed as an endless belt, and is looped around the plurality of support rollers 423. At least one of the plurality of support rollers 423 is formed as a driving roller, and the other rollers are formed as driven rollers. As the driving roller rotates, the intermediate transfer belt 421 runs in the A direction A at a constant speed.

The intermediate transfer belt 421 is a belt having conductivity and elasticity, and is driven to be rotated by a control signal from the control unit 90.

The primary transfer roller 422 is disposed on the inner circumferential surface side of the intermediate transfer belt 421 so as to face the photosensitive drum 413 of the corresponding color component. The primary transfer roller 422 comes in pressing contact with the photosensitive drum 413 with the intermediate transfer belt 421 interposed between such that a primary transfer nip for transferring a toner image from the photosensitive drum 413 to the intermediate transfer belt 421 is formed.

The secondary transfer roller 424 is disposed on the outer circumferential surface side of the intermediate transfer belt 421 so as to face a backup roller 423B disposed on the downstream side of a driving roller 423A in the belt running direction. The secondary transfer roller 424 comes in pressing contact with the backup roller 423B with the intermediate transfer belt 421 interposed therebetween such that a secondary transfer nip for transferring the toner image from the intermediate transfer belt 421 to the sheet S is formed.

The belt cleaning device 426 removes the transfer residual toner remaining on the surface of the intermediate transfer belt 421 after the secondary transfer.

When the intermediate transfer belt 421 passes through the primary transfer nip, the toner images on the photosensitive drums 413 are sequentially superimposed and primarily transferred onto the intermediate transfer belt 421. Specifically, a primary transfer bias is applied to the primary transfer roller 422 to apply a charge having a polarity opposite to that of the toner to the rear surface side of the intermediate transfer belt 421, that is, the side in contact with the primary transfer roller 422, thereby electrostatically transferring the toner images to the intermediate transfer belt 421.

Thereafter, when the sheet S passes through the secondary transfer nip, the toner image on the intermediate transfer belt 421 is secondarily transferred to the sheet S. Specifically, a secondary transfer bias is applied to the backup roller 423B by a bias application unit (not illustrated) to apply a charge having the same polarity as the toner to the front surface side of the sheet S, that is, the side in contact with the intermediate transfer belt 421, thereby electrostatically transferring the toner image to the sheet S. The sheet S to which the toner image has been transferred is conveyed toward the fixing unit 60.

The fixing unit 60 includes an upper fixing unit 60A having a fixing surface side member disposed on the side of the surface of the sheet S on which a toner image is formed, a lower fixing unit 60B having a rear surface side support member disposed on the side of the surface opposite to the fixing surface, which is the rear surface of the sheet S, and the like. As the rear surface side support member comes in pressing contact with the fixing surface side member, a fixing nip for nipping and conveying the sheet S is formed.

The fixing unit 60 heats and presses the sheet S, which is conveyed after the secondary transfer of the toner image, with the fixing nip, thereby fixing the toner image on the sheet S. The fixing unit 60 is disposed as a unit in a fixing device F. In addition, an air separation unit which blows air to separate the sheet S from the fixing surface side member or the rear surface side support member may be disposed in the fixing device F.

The upper fixing unit 60A has an endless fixing belt 61, a heating roller 62, and a fixing roller 63 as the fixing surface side member. The fixing belt 61 is stretched by the heating roller 62 and the fixing roller 63.

The heating roller 62 has a heating source (halogen heater) embedded therein and heats the fixing belt 61. The heating roller 62 is heated by the heating source, and as a result, the fixing belt 61 is heated.

The fixing roller 63 is controlled and driven by the control unit 90 to rotate in a clockwise direction. As the fixing roller 63 rotates, the fixing belt 61 and the heating roller 62 are rotated in the clockwise direction.

The lower fixing unit 60B has a pressing roller 64 as the rear surface side support member. The pressing roller 64 forms the fixing nip for nipping and conveying the sheet S between the pressing roller 64 and the fixing belt 61. The pressing roller 64 is controlled and driven by the control unit 90 to rotate in a counterclockwise direction.

The sheet conveying unit 50 includes a feeding unit 51, a discharge unit 52, a conveyance path unit 53, and the like. In three feed tray units 51*a* to 51*c* constituting the feeding unit 51, sheets S (standard paper, or special paper) identified based on basis weight, size, and the like are accommodated for each preset type. The conveyance path unit 53 has a plurality of conveying roller pairs such as a registration roller pair 53*a*.

The conveyance path unit 53 includes the plurality of conveying roller pairs such as the registration roller pair 53*a*, a normal conveyance path 53*b* which allows the sheet S to pass through the image forming unit 40 and the fixing unit 60 and discharges the sheet S to the outside of the apparatus, and a reverse conveyance path 53*c* for reverses the front and rear of the sheet S that has passed through the fixing unit 60 and thereafter causes the sheet S to join the normal conveyance path 53*b* again on the upstream side of the image forming unit 40. During duplex printing, a toner image is formed on the front surface of the sheet S when the sheet S first passes through the normal conveyance path 53*b*, and after passage through the reverse conveyance path 53*c*, a toner image is formed on the rear surface of the sheet S when the sheet S passes through the normal conveyance path 53*b* again.

Sheets S accommodated in the feed tray units 51*a* to 51*c* are sent one by one from the top and are conveyed to the image forming unit 40 by the conveyance path unit 53. At this time, the inclination of the fed sheet S is corrected and the conveyance timing is adjusted by a registration roller unit in which the registration roller pair 53*a* is disposed. In addition, in the image forming unit 40, the toner images on the intermediate transfer belt 421 are collectively secondarily transferred onto one side of the sheet S, and a fixing process is performed in the fixing unit 60. The sheet S on which an image is formed is discharged to the outside of the apparatus by the discharge unit 52 provided with a discharge roller 52*a*.

Figure 4:
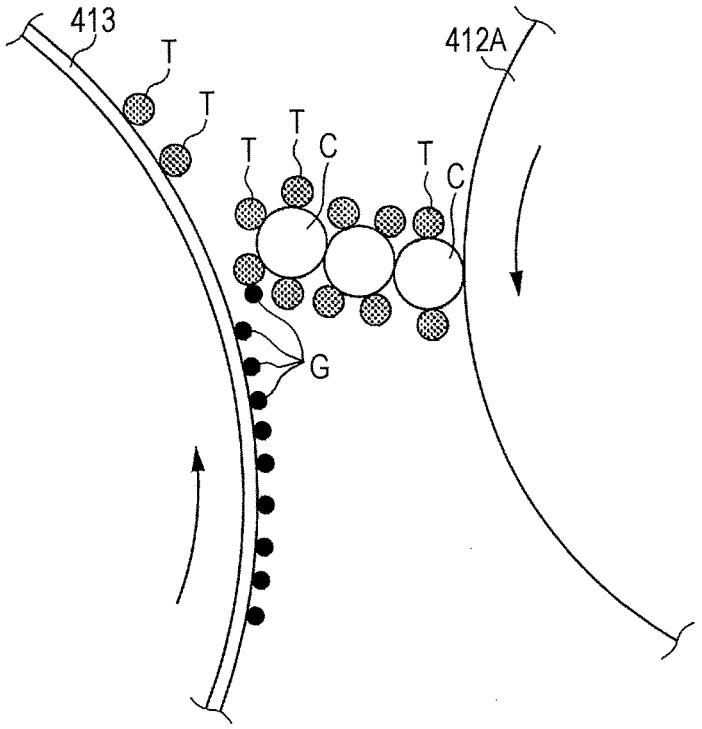
FIG. 4 is an enlarged view of parts in which a developing sleeve and the photosensitive drum face each other.

However, as illustrated in FIG. 4, as the photosensitive drum 413 rotates, the lubricant G supplied to the photosensitive drum 413 by the lubricant application device 416 moves to a position facing the developing sleeve 412A. At this time, there may be a case where the lubricant G is scraped off from the surface of the photosensitive drum 413 by a magnetic brush constituted by the toner T and a carrier C contained in the developer. The lubricant G scraped off by the magnetic brush is incorporated into the developing device 412 and adheres to the toner T accommodated in the developing device 412. The lubricant G adhered to the toner T impedes triboelectric charging between the toner T and the carrier C. As a result, a state in which toner with a reduced charge amount is present in the developing device 412 or a state in which toners which are positively charged and negatively charged coexist with each other is caused. Accordingly, image defects caused by fogging, toner scattering, and the like are likely to be generated.

Therefore, in this embodiment, the lubricant concentration detection unit 100 detects the concentration of the lubricant with respect to the developer in the developing device 412. In a case where the concentration of the lubricant detected by the lubricant concentration detection unit 100 is higher than a predetermined concentration (for example, a lubricant proportion of 1 at % in the developer), the control unit 90 causes a toner band to be discharged onto the photosensitive drum 413 so as to discharge the lubricant from the developing device 412. In this manner, the amount of the lubricant incorporated into the developing device 412 can be reduced. Hereinafter, details of the lubricant concentration detection unit 100 will be described. The lubricant concentration detection unit 100 corresponds to a "lubricant amount detection unit" of the present invention, and the concentration of the lubricant corresponds to "the amount of a lubricant" of the present invention.

Figure 5:
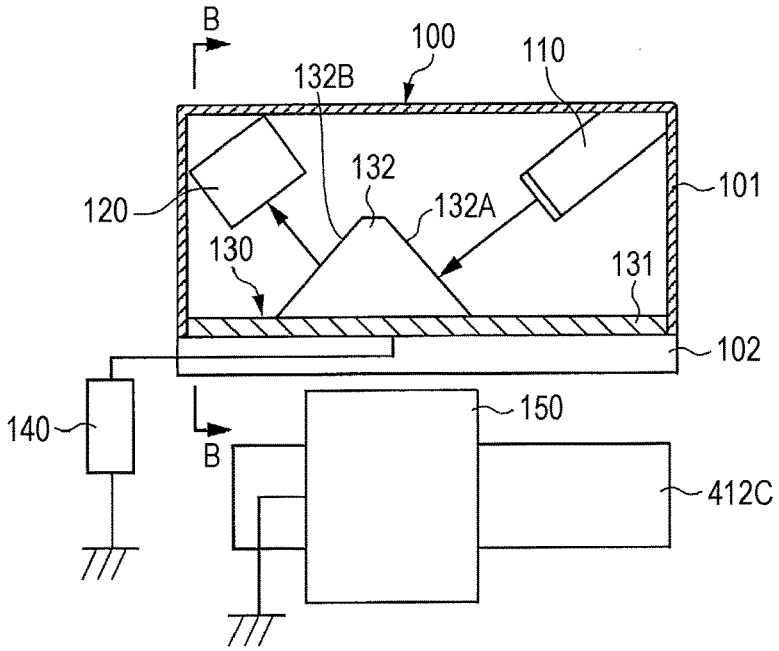
FIG. 5 is a view of a lubricant concentration detection unit viewed in a section taken along line A-A in FIG. 3.
Figure 6:
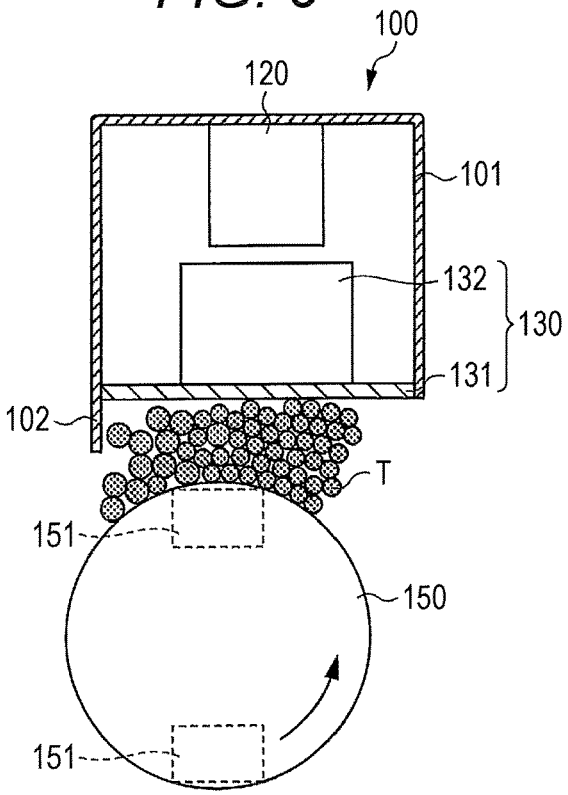
FIG. 6 is a view of the lubricant concentration detection unit viewed in a section taken along line B-B in FIG. 5.

FIG. 5 is a view of the lubricant concentration detection unit 100 viewed in a section taken along line A-A in FIG. 3. FIG. 6 is a view of the lubricant concentration detection unit 100 viewed in a section taken along line B-B in FIG. 5.

As illustrated in FIG. 5, the lubricant concentration detection unit 100 includes a housing 101, a light-emitting unit 110, a light-receiving unit 120, a developer adhesion unit 130, and a bias application unit 140.

As illustrated in FIGS. 5 and 6, the housing 101 is formed in a box shape which is open downward, and accommodates the light-emitting unit 110 and the light-receiving unit 120 therein. In addition, a barrier wall 102 is formed on the left side of the housing 101 in FIG. 6. The barrier wall 102 protrudes downward from the developer adhesion unit 130 (a lid portion 131 described later) so as to prevent the toner T adhered to the developer adhesion unit 130 from flowing toward the left side in FIG. 6 over the barrier wall 102 as a conveying member 150, which will be described later, rotates. Accordingly, the toner T can be prevented from being conveyed by the conveying member 150 before the concentration of the lubricant in the toner T is detected.

As illustrated in FIG. 5, the light-emitting unit 110 is a part that emits light, and is provided at the right end portion of the upper wall of the housing 101 in FIG. 5. The light-receiving unit 120 is a part that receives the light emitted by the light-emitting unit 110, and is provided at the left end portion of the upper wall of the housing 101 in FIG. 5. The developer adhesion unit 130 is formed to be transparent and has the lid portion 131 and a reflecting portion 132.

The lid portion 131 is disposed at a position to close the opening of the housing 101 and is connected to the bias application unit 140. Under the control of the control unit 90, the bias application unit 140 applies a predetermined bias, which is a bias having a polarity opposite to that of the toner T, to the lid portion 131. Accordingly, the toner T contained in the developer in the developing device 412 is adhered to the lid portion 131 part due to electrostatic attraction.

The reflecting portion 132 protrudes from the lid portion 131 and is formed into a triangular prism shape which is tapered toward the upper side in FIG. 5. The reflecting portion 132 has a first inclined surface 132A extending obliquely downward toward the right from the vertex and a second inclined surface 132B extending obliquely downward toward the left from the vertex. The first inclined surface 132A faces the light-emitting unit 110, and light emitted from the light-emitting unit 110 is incident thereon. The second inclined surface 132B faces the light-receiving unit 120, and reflects the light incident on the first inclined surface 132A toward the light-receiving unit 120.

When the light is emitted from the light-emitting unit 110 toward the reflecting portion 132, the lubricant concentration detection unit 100 receives the amount of light reflected from the toner T adhered to the lid portion 131 from the light-receiving unit 120, and outputs the amount of the light to the control unit 90. The control unit 90 calculates the concentration of the lubricant in the toner T adhered to the lid portion 131 from the amount of light reflected from the toner T. By calculating the concentration of the lubricant as described above, the control unit 90 performs control to discharge the lubricant from the developing device 412.

The conveying member 150 is provided in the first agitating member 412C, which faces the lubricant concentration detection unit 100. The conveying member 150 faces a part of the lid portion 131 on which the reflecting portion 132 is disposed, and conveys the toner T to the part of the lid portion 131. The conveyed toner T is adhered to the lid portion 131.

Two magnets 151 are disposed on the inner circumferential surface of the conveying member 150 so as to face each other. The conveying member 150 removes the toner T from the lid portion 131 by attracting the carrier (not illustrated) that holds the toner T adhered to the lid portion 131, with the magnets 151. Since the lubricant is incorporated into the developing device 412, while the toner T remains attached to the lid portion 131, the concentration of the current lubricant cannot be detected. However, since the toner T adhered to the lid portion 131 can be removed by the conveying member 150, the toner T adhered to the lid portion 131 can be the latest toner. The conveying member 150 corresponds to a "cleaning member" of the present invention.

Figure 7:
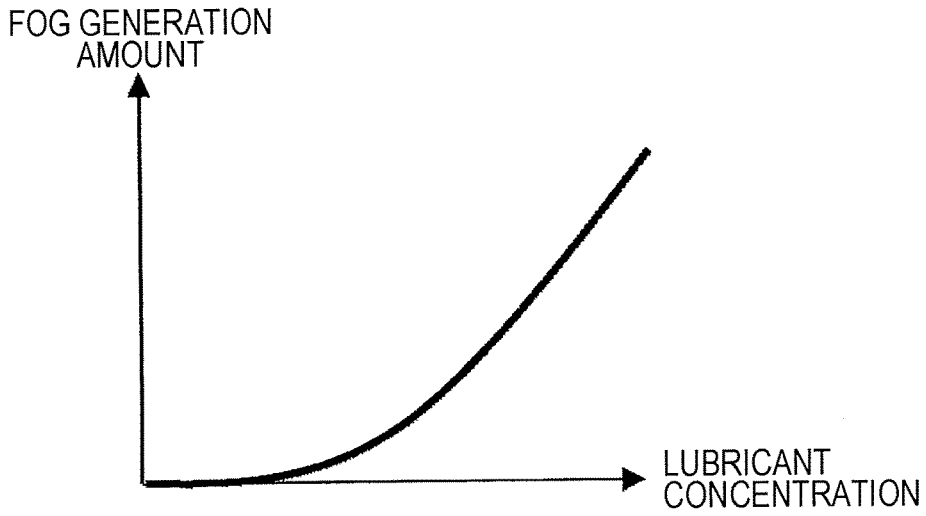
FIG. 7 is a view showing a fog generation amount with respect to the concentration of a lubricant.
Figure 8:
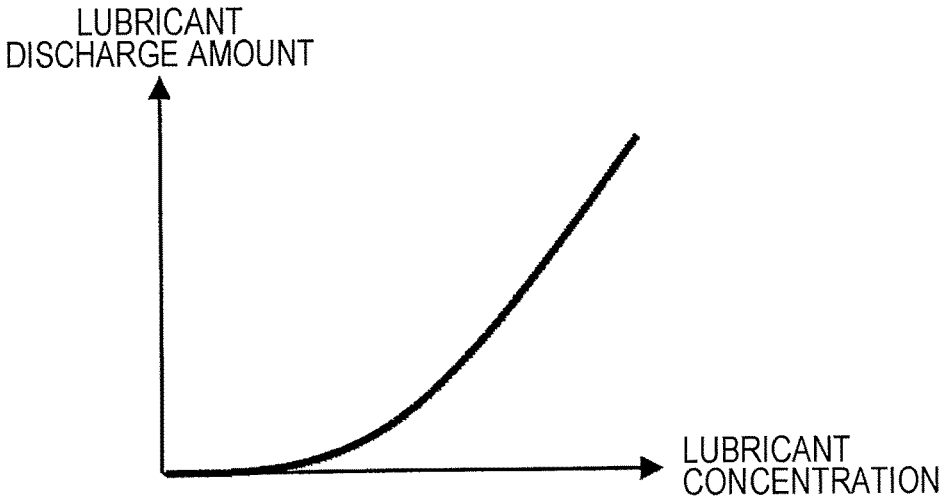
FIG. 8 is a view showing the discharge amount of the lubricant with respect to the concentration of the lubricant.

However, as illustrated in FIG. 7, it has been experimentally confirmed that the amount of fog generated due to an increase in the concentration of the lubricant in the developing device 412 increases as the concentration of the lubricant increases. Therefore, the control unit 90 performs control to change the discharge amount of the lubricant according to the concentration of the lubricant in the developing device 412. Specifically, the control unit 90 controls the developing device 412 so as to increase the discharge amount of the lubricant in the developing device 412 as the concentration of the lubricant increases. For example, as illustrated in FIG. 8, the control unit 90 controls the discharge amount of the lubricant so as to cause the relationship between the concentration of the lubricant and the discharge amount of the lubricant to be the same as the relationship between the concentration of the lubricant and the amount of fog generated in FIG. 7. In this manner, appropriate lubricant discharge control for the amount of the lubricant in the developing device 412 can be performed.

In addition, during image formation, the toner is discharged to the photosensitive drum 413, and accordingly, the lubricant is also discharged to the photosensitive drum 413. Therefore, in a case where the area ratio of an image is equal to or higher than a predetermined area ratio (for example, 3% with respect to the entire image formation area), even though the lubricant discharge control is not performed, the concentration of the lubricant in the developing device 412 is suppressed to a relatively low concentration. Here, the control unit 90 determines whether or not to detect the concentration of the lubricant according to the area ratio of the image formed on the photosensitive drum 413. Specifically, in a case where the area ratio of the image on the photosensitive drum 413 is equal to or higher than the predetermined area ratio, the control unit 90 controls not to discharge the lubricant from the developing device 412, that is, not to detect the concentration of the lubricant. Accordingly, there is no need to unnecessarily operate the lubricant concentration detection unit 100, and power consumption can be reduced. The area ratio of the image on the photosensitive drum 413 may be, for example, the average image area ratio of images that have been formed most recently.

Furthermore, even when a non-image area is caused such as at a timing between sheets, that is, even when the toner is not supplied to the photosensitive drum 413, the lubricant is supplied to the photosensitive drum 413. Therefore, even at such a time, the lubricant supplied to the photosensitive drum 413 is incorporated into the developing device 412. At this time, since the toner in the developing device 412 is not discharged, the concentration of the lubricant in the developing device 412 increases. However, for example, in a case where the amount of the lubricant supplied to the photosensitive drum 413 becomes insufficient due to wear of the brush roller 416B, when the non-image area is caused, it is thought that the amount of the lubricant on the photosensitive drum 413 is small and thus the amount of the lubricant incorporated into the developing device 412 also becomes small.

Therefore, based on the amount of variation in the concentration of the lubricant in the developing device 412 when the toner is not supplied to the photosensitive drum 413, the control unit 90 changes the amount of the lubricant to be supplied to the photosensitive drum 413 from the lubricant application device 416. For example, in a case where the amount of variation in the concentration of the lubricant in the developing device 412 is small, the control unit 90 determines that the amount of the lubricant supplied to the photosensitive drum 413 is insufficient, causes the amount of the lubricant supplied to the photosensitive drum 413 from the lubricant application device 416. In this manner, the amount of the lubricant supplied to the photosensitive drum 413 can be set to an appropriate amount. In addition, the control unit 90 can control the amount of the supplied lubricant, for example, by controlling the rotation speed of the brush roller 416B.

Furthermore, in a case where the solid lubricant 416A is depleted, the lubricant is not supplied to the photosensitive drum 413. In this case, the lubricant is not incorporated into the developing device 412 when the non-image area is caused, and the concentration of the lubricant does not vary. In this aspect, the control unit 90 may perform control to determine whether or not the lubricant is supplied to the photosensitive drum 413, based on the amount of variation in the concentration of the lubricant in the developing device 412 when the toner is not supplied to the photosensitive drum 413. In a case where the control unit 90 determines that the lubricant is not supplied to the photosensitive drum 413, that is, the solid lubricant 416A is depleted, for example, a warning that urges the replacement of the lubricant application device 416 may displayed on the display unit 21 or the like.

In addition, in a case where the toner is fixed to the developer adhesion unit 130, the detection accuracy of the lubricant concentration detection unit 100 deteriorates, and the concentration of the lubricant is less likely to vary. In this case, if it is determined that the amount of the lubricant supplied to the photosensitive drum 413 is insufficient, there is a possibility that the amount of the lubricant supplied to the photosensitive drum 413 may be increased even though the lubricant is supplied to the photosensitive drum 413. Therefore, the control unit 90 may perform control to determine whether the detection accuracy of the lubricant concentration detection unit 100 is good or bad, based on the amount of variation in the concentration of the lubricant detected by the lubricant supply amount detection unit 416D when the toner is not supplied to the photosensitive drum 413. In a case where it is determined that the detection accuracy of the lubricant concentration detection unit 100 is bad, the control unit 90 may display a warning that notifies the abnormality of the lubricant concentration detection unit 100, for example, on the display unit 21.

Figure 9:
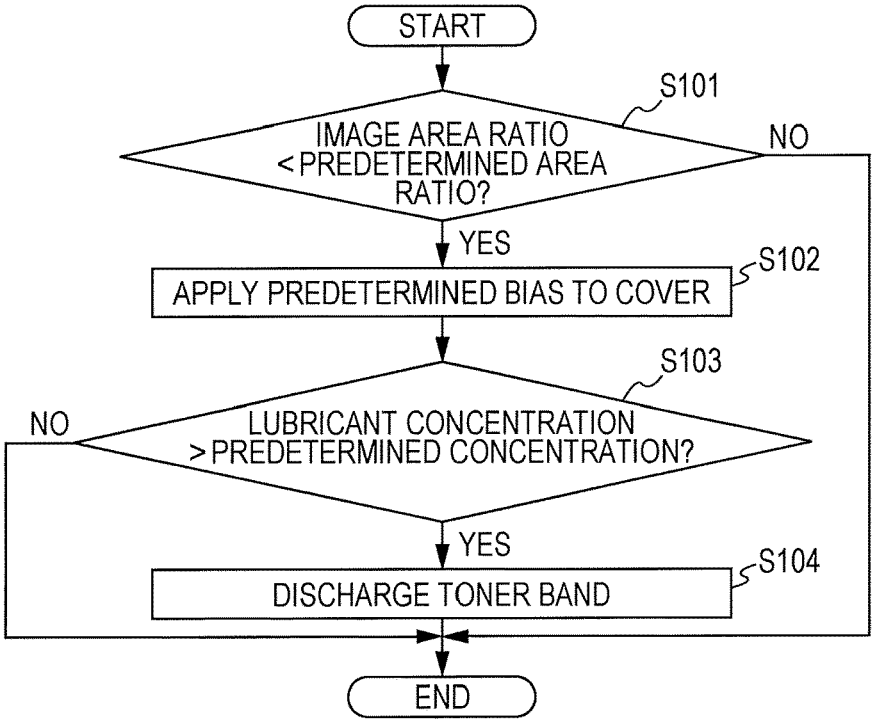
FIG. 9 is a flowchart showing an example of an operation example of lubricant discharge control in the image forming apparatus.

Next, an operation example of the lubricant discharge control in the image forming apparatus 1 provided with the control unit 90 described above will be described. FIG. 9 is a flowchart showing an example of the operation example of the lubricant discharge control in the image forming apparatus 1. The process in FIG. 9 is performed at the timing between sheets during continuous printing.

As shown in FIG. 9, the control unit 90 determines whether or not the image area ratio is lower than the predetermined area ratio (step S101). As a result of the determination, in a case where the image area ratio is equal to or higher than the predetermined area ratio (NO in step S101), the control unit 90 ends this control. On the other hand, in a case where the image area ratio is lower than the predetermined area ratio (YES in step S101), the control unit 90 applies a predetermined bias to the lid portion 131 to cause the developer to be adhered to the lid portion 131 (step S102).

Next, the control unit 90 determines whether or not the concentration of the lubricant is higher than the predetermined concentration (step S103). As a result of the determination, in a case where the concentration of the lubricant is equal to or lower than the predetermined concentration (NO in step S103), the control unit 90 ends this control. On the other hand, in a case where the concentration of the lubricant is higher than the predetermined density (YES in step S103), the control unit 90 discharges the toner band in an amount corresponding to the concentration of the lubricant to the photosensitive drum 413 (step S104). Thereafter, the control unit 90 ends this control.

According to the image forming apparatus 1 according to the embodiment configured as described above, since the discharge control of the lubricant is performed according to the concentration of the lubricant in the developing device 412, image defects caused by fogging, toner scattering, and the like in a case where the concentration of the lubricant in the developing device 412 increases can be suppressed.

In addition, since the concentration of the lubricant is detected by causing the developer in the developing device 412 to be adhered to the developer adhesion unit 130, the concentration of the lubricant in the developing device 412 can be accurately detected.

In addition, since the developer adhered to the developer adhesion unit 130 is removed from the lid portion 131 by the conveying member 150, the developer adhered to the lid portion 131 can be the latest developer.

In addition, since the discharge amount of the lubricant is changed according to the concentration of the lubricant, appropriate lubricant discharge control can be performed according to the amount of the lubricant in the developing device 412.

In addition, since whether or not to detect the concentration of the lubricant is determined on the basis of the image area ratio, in a case where it is determined not to detect the concentration of the lubricant, the lubricant concentration detection unit 100 can be prevented from being unnecessarily operated.

Figure 10:
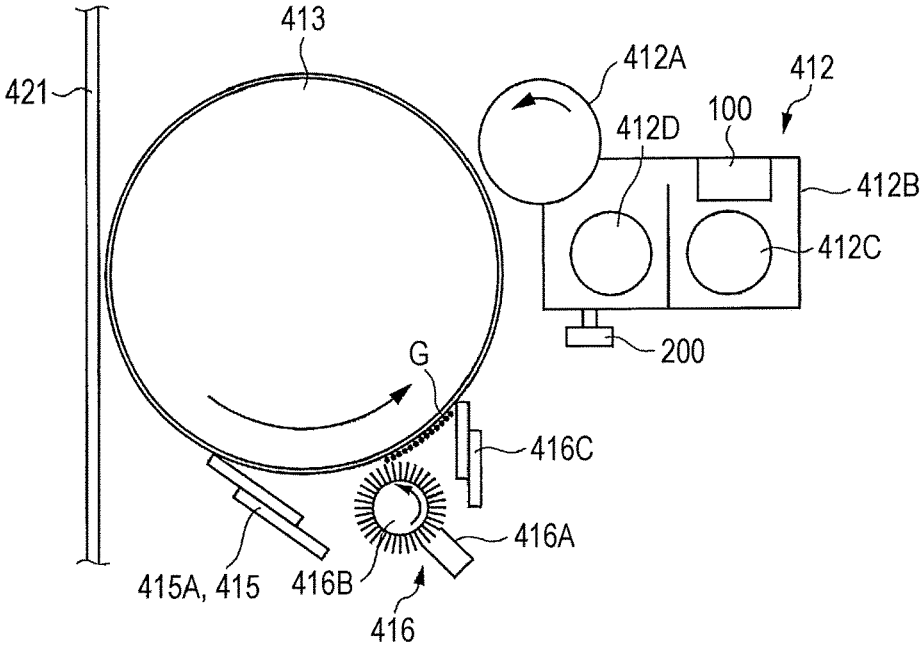
FIG. 10 is a view illustrating parts of the developing device and the photosensitive drum according to a modification example.

In the embodiment described above, the lubricant is discharged to the outside of the developing device 412 by discharging the toner band to the photosensitive drum 413. However, the present invention is not limited thereto, and as illustrated in FIG. 10, the lubricant may be discharged by discharging the developer in the developing device 412 to another container.

The developing device 412 in this configuration is provided with a discharge container 200. The discharge container 200 communicates with the bottom wall of the developer housing 412B of the developing device 412. The discharge container 200 is positioned at a position corresponding to an area of the developer housing 412B where the second agitating member 412D is disposed.

Figure 11:
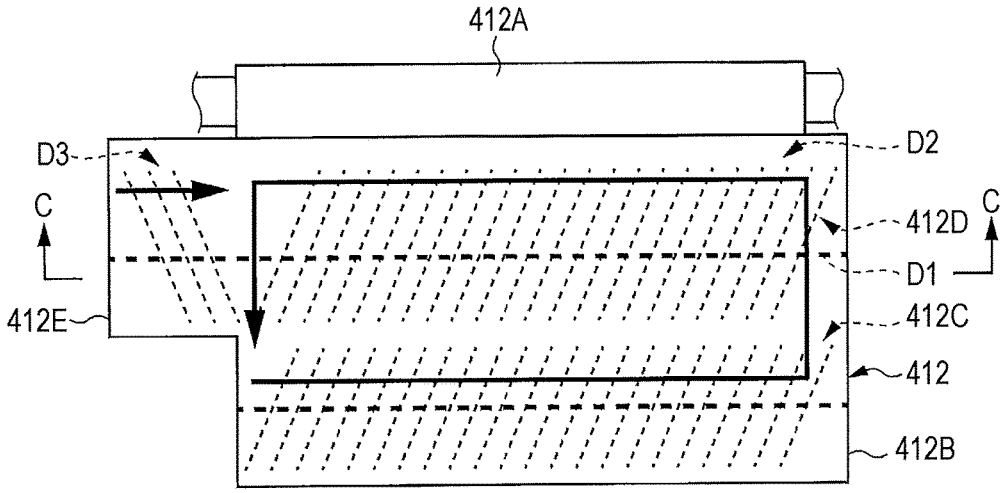
FIG. 11 is a view of the developing device according to the modification example viewed from above.
Figure 12:
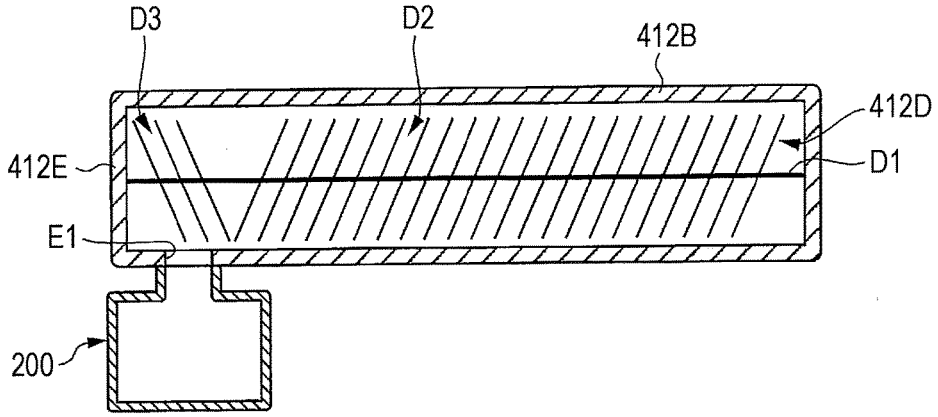
FIG. 12 is a sectional view of the developing device according to the modification example taken along line C-C in FIG. 11.

As illustrated in FIG. 11, in this configuration, the developer housing 412B is configured so that the area where the second agitating member 412D is disposed is longer in left and right directions in FIG. 11 than an area where the first agitating member 412C is disposed. Specifically, the developer housing 412B is configured so that a part where the second agitating member 412D is disposed protrudes toward the left side from a part where the first agitating member 412C is disposed. A part of the developer housing 412B protruding toward the left side serves as a discharge housing 412E. As illustrated in FIG. 12, the discharge container 200 communicates with the inside of the developer housing 412B via an opening E1 formed at the bottom of the discharge housing 412E.

In addition, as illustrated in FIG. 11, in this configuration, the second agitating member 412D is configured to be longer in the left and right directions in FIG. 11 than the first agitating member 412C, and is positioned in an area corresponding to the first agitating member 412C and an area of the discharge housing 412E in the developer housing 412B. The second agitating member 412D has a rotation axis D1, and a first blade member D2 and a second blade member D3 disposed on the rotation axis D1.

The first blade member D2 is positioned in the area where the first agitating member 412C in the developer housing 412B in the left and right directions in FIG. 11. As the second agitating member 412D rotates, the first blade member D2 generates a flow in which the developer is directed from the right to the left in FIG. 11. In addition, the first agitating member 412C generates a flow from the left to the right while rotating. In addition, in the developer housing 412B, at positions corresponding to both the left and right end portions of the first agitating member 412C, the areas where the first agitating member 412C and the second agitating member 412D are disposed are connected. Therefore, the developer flows so as to circulate in the developer housing 412B as illustrated in FIG. 11. Accordingly, the developer in the developer housing 412B is agitated.

The second blade member D3 is disposed in the discharge housing 412E. The second blade member D3 faces in a direction different from that of the first blade member D2 and generates a flow from the left to the right as the second agitating member 412D rotates. When the second agitating member 412D rotates, the toner flows from the right to the left, and the developer is likely to infiltrate into the discharge housing 412E. However, the infiltrated developer is pushed back by the second blade member D3, and thus the developer does not enter the discharge housing 412E.

Here, in a case where the concentration of the lubricant becomes higher than the predetermined concentration, the developer is supplied into the developing device 412 by the control unit 90. Accordingly, the amount of the developer in the developer housing 412B increases, and the developer flows over the developer housing 412B against the pushing-back force of the second blade member D3 and infiltrates into the discharge housing 412E. As illustrated in FIG. 12, the developer infiltrated into the discharge housing 412E is accommodated in the discharge container 200 via the opening E1. In this manner, the lubricant adhered to the toner contained in the developer is discharged to the discharge container 200. With this configuration, the lubricant can also be discharged from the developing device 412 according to the concentration of the lubricant.

The present invention can be applied to an image forming system constituted by a plurality of units including an image forming apparatus. The plurality of units include external devices such as a post-processing device, a control device connected to a network, and the like.

Although the present invention has been described and illustrated in detail, it is clearly understood that the same is by way of illustrated and example only and is not to be taken by way of limitation, the scope of the present invention being interpreted by terms of the appended claims. That is, the present invention can be embodied in various forms without departing from the gist or the main features thereof.

What is claimed is:

1. An image forming apparatus comprising:

an image carrier;

a developing unit which supplies a toner contained in a developer to the image carrier;

a lubricant supply unit which supplies a lubricant to the image carrier;

a lubricant amount detection unit which detects an amount of the lubricant in the developing unit which was supplied to the image carrier from the lubricant supply unit and is in the developing unit; and a control unit which controls the developing unit to discharge the lubricant from the developing unit according to the amount of the lubricant detected by the lubricant amount detection unit.

2. The image forming apparatus according to claim 1, wherein the lubricant amount detection unit includes a developer adhesion unit to which the developer in the developing unit is adhered, and detects the amount of the lubricant from an amount of light reflected from the developer when the developer adhered to the developer adhesion unit is irradiated with the light.

3. The image forming apparatus according to claim 2, further comprising:

a bias application unit which applies a bias to the developer adhesion unit, wherein the control unit controls the bias application unit to apply a bias having a polarity opposite to that of the toner in the developing unit, to the developer adhesion unit.

4. The image forming apparatus according to claim 2, wherein the developing unit includes a cleaning member which removes the developer adhered to the developer adhesion unit.

5. The image forming apparatus according to claim 1, wherein the control unit changes a discharge amount of the lubricant according to the amount of the lubricant in the developing unit.

6. The image forming apparatus according to claim 5, wherein the control unit controls the developing unit to increase the discharge amount of the lubricant in the developing unit as the amount of the lubricant in the developing unit increases.

7. The image forming apparatus according to claim 1, wherein the control unit controls the developing unit to discharge the lubricant in the developing unit by supplying the toner to the image carrier.

8. The image forming apparatus according to claim 1, further comprising:

a developer discharge unit which communicates with inside of the developing unit to cause the developer in the developing unit to be discharged.

9. The image forming apparatus according to claim 1, wherein the control unit determines whether or not the lubricant is supplied to the image carrier based on an amount of variation in the lubricant in the developing unit.

10. The image forming apparatus according to claim 1, wherein the control unit changes a supply amount of the lubricant to the image carrier from the lubricant supply unit according to the amount of variation in the lubricant in the developing unit.

11. The image forming apparatus according to claim 10, wherein the lubricant supply unit includes a solid lubricant, a brush roller which supplies the lubricant scraped off from the solid lubricant to the image carrier, and the control unit controls the supply amount of the lubricant by controlling a rotation speed of the brush roller.

12. The image forming apparatus according to claim 1, further comprising:

a lubricant supply amount detection unit which detects a supply amount of the lubricant to the image carrier, wherein the control unit controls the lubricant supply unit to cause the supply amount of the lubricant to the image carrier to be a constant amount based on the supply amount of the lubricant to the image carrier detected by the lubricant supply amount detection unit, and determines whether or not detection accuracy of the lubricant amount detection unit is good or bad, based on an amount of variation in the lubricant in the developing unit.

13. The image forming apparatus according to claim 1, wherein the control unit determines whether or not to detect an amount of the lubricant in the developing unit based on an area ratio of an image formed on the image carrier.

14. The image forming apparatus according to claim 1, wherein the control unit does not discharge the lubricant from the developing unit in a case where an area ratio of the image formed on the image carrier is equal to or higher than a predetermined area ratio.

15. The image forming apparatus according to claim 1, wherein the lubricant is a metal soap.

16. A lubricant discharge control method of an image forming apparatus including an image carrier, a developing unit which supplies toner contained in a developer to the image carrier, and a lubricant supply unit which supplies a lubricant to the image carrier, the method comprising:

acquiring an amount of the lubricant which was supplied to the image carrier from the lubricant supply unit and is in the developing unit; and controlling the developing unit to discharge the lubricant from the developing unit according to the acquired amount of the lubricant.

17. The lubricant discharge control method according to claim 16, wherein the lubricant amount detection unit includes a developer adhesion unit to which the developer in the developing unit is adhered, and detects the amount of the lubricant from an amount of light reflected from the developer when the developer adhered to the developer adhesion unit is irradiated with the light.

18. The lubricant discharge control method according to claim 16, wherein the control unit changes a discharge amount of the lubricant according to the amount of the lubricant in the developing unit.

19. The lubricant discharge control method according to claim 16, wherein the control unit changes a supply amount of the lubricant to the image carrier from the lubricant supply unit according to an amount of variation in the lubricant in the developing unit.

20. An image forming apparatus comprising:

an image carrier;

a developing unit which supplies a toner contained in a developer to the image carrier;

a lubricant supply unit which supplies a lubricant to the image carrier;

a lubricant amount detection unit which detects an amount of the lubricant which was supplied to the image carrier from the lubricant supply unit and is in the developing unit; and a control unit which controls the developing unit to discharge the lubricant from the developing unit according to the amount of the lubricant detected by the lubricant amount detection unit, wherein the control unit controls the developing unit to increase a discharge amount of the lubricant in the developing unit as the amount of the lubricant in the developing unit increases.

* * * * *